United States Patent [19]

Bowman

[11] Patent Number: 4,682,147

[45] Date of Patent: Jul. 21, 1987

[54] EMERGENCY SIGN

[75] Inventor: Norman E. Bowman, Jonesboro, Ark.

[73] Assignee: Don Gilbert Industries, Inc., Jonesboro, Ark.

[21] Appl. No.: 929,514

[22] Filed: Nov. 12, 1986

Related U.S. Application Data

[63] Continuation of Ser. No. 749,813, Jun. 28, 1985, abandoned.

[51] Int. Cl.[4] ..... G08B 7/00

[52] U.S. Cl. ..... 340/286 R; 40/570; 307/66; 315/86

[58] Field of Search ..... 340/286 R, 815.03, 782, 340/761, 636, 661; 40/570, 550; 307/66; 315/86; 362/183; 320/40

[56] References Cited

U.S. PATENT DOCUMENTS

| | | | |
|---|---|---|---|
| 3,659,179 | 4/1972 | Barker et al. | 362/183 |
| 3,795,818 | 3/1974 | Beaman et al. | 307/66 |
| 3,869,639 | 3/1975 | Herzog | 315/86 |
| 4,071,749 | 1/1978 | Balogh | 307/66 |
| 4,225,792 | 9/1980 | Fahey | 307/66 |
| 4,238,690 | 12/1980 | Clarke | 307/66 |
| 4,271,408 | 6/1981 | Teshima et al. | 340/782 |
| 4,298,869 | 11/1981 | Okuno | 340/815.03 |
| 4,354,118 | 10/1982 | Spencer | 307/66 |
| 4,386,308 | 5/1983 | Emile, Jr. et al. | 307/66 |
| 4,388,615 | 6/1983 | Ford et al. | 307/66 |
| 4,395,639 | 7/1983 | Bring | 307/66 |
| 4,489,308 | 12/1984 | Logan, Jr. et al. | 340/286 R |
| 4,544,910 | 10/1985 | Hoberman | 307/66 |

OTHER PUBLICATIONS

Markus, John, Sourcebook of Electronic Circuits, McGraw-Hill, 1968, p. 593.

*Primary Examiner*—John W. Caldwell, Sr.
*Assistant Examiner*—Tyrone Queen

[57] ABSTRACT

An illuminated exit sign having a plurality of series connected light emitting diodes arranged to form the word "exit" and a control circuit for supplying power to the series connected diodes from line power and, during power failures, from battery power. The control circuit illuminates the diodes continuously during normal operation and alternately switches the diodes on and off during a power failure.

9 Claims, 6 Drawing Figures

EMERGENCY SIGN

This is a continuation of application Ser. No. 749,813, filed June 28, 1985, now abandonded.

BACKGROUND OF THE INVENTION

1. Field of the Invention

The present invention relates generally to an illuminated sign and, in particular, to a control circuit for supplying AC and DC power to a plurality of series connected light sources in an sign.

2. Prior Art

Many types of emergency exit signs are shown in the art including those that operate on either AC or DC power. Exit signs of this type frequently require two sets of illuminating lamps, one set for AC operation and a second set for DC operation. Many of the known emergency exit signs use incandescent light bulbs as an illuminating source which use a comparatively high amount of power, thus draining a battery rapidly during DC operation. Also, incandescent light bulbs have a tendency to burn out and must be replaced periodically, adding maintenance costs to the overall cost of the exit sign.

It would be an improvement over the prior art exit signs to provide a single illuminating source for both AC and DC operation which consumes relatively little power and which has a comparatively long life so that it requires infrequent replacement.

SUMMARY OF THE INVENTION

It is an object of the present invention to provide a highly visible emergency sign which requires infrequent maintenance.

It is another object of the present invention to provide an sign control circuit that automatically charges a battery during AC operation and that, upon power failure, switches to DC operation and increases the visibility of its display.

The above objects are inventively achieved in an emergency sign and control circuit having light sources, which are preferably light emitting diodes, connected in a plurality of series combinations each having a predetermined number of light sources. The series combinations are connected in parallel across the output of the control circuit. The control circuit applies continuous power to the light sources during AC operation and charges a battery when required. An indicator on the sign shows the charging state of the battery. When a power failure occurs, the control circuit pulses battery power to the light source causing the illuminated display to flash. Battery power is continued until the battery reaches a predetermined minimum voltage, at which time the control circuit shuts the light sources off, or until AC power is restored, when the sign will again be continuously illuminated and the battery recharged.

The present device thus provides an illuminated sign preferably using light emitting diodes which provide improved visibility, use low power for longer DC operation, and have a longer life for infrequent replacement. By connecting the light emitting diodes in series combinations, a correct voltage drop may be supplied across each light emitting diode without using series resistors. The elimination of series resistors from the device reduces power consumption and improves visibility of the sign. The present invention, thus, provides an improved sign having many features distinguishable over the prior art.

DESCRIPTION OF THE PREFERRED EMBODIMENT

Figure 1:
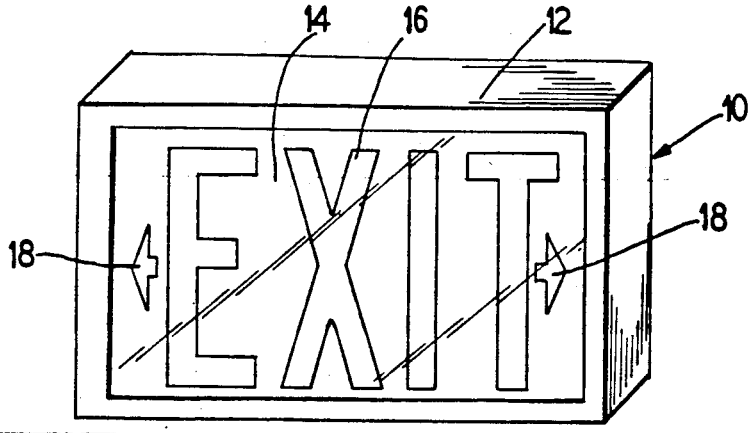
FIG. 1 is a perspective view of an emergency sign embodying the principles of the present invention.

In FIG. 1, an illuminated emergency sign of the present invention, in the form of an exit sign, is shown generally at 10 having a housing 12 and a display board 14 with the word "EXIT" marked thereon at 16 and arrows pointing in opposed directions at 18. A second display board 14 substantially identical to the first may be mounted in the other side of the housing 12.

Figure 2:
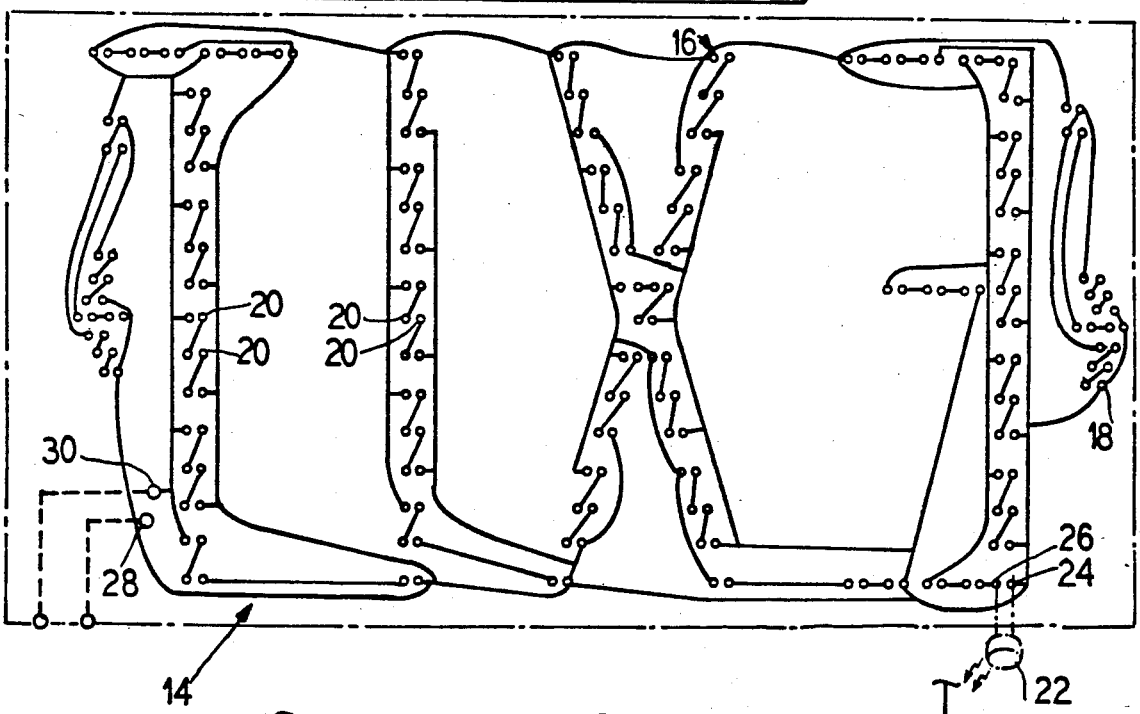
FIG. 2 is a rear elevational view of a display portion of the sign of FIG. 1, including connections for light emitting diodes in series combinations of three.

FIG. 2 shows a rear view of the display board 14 of FIG. 1 having connections 20 for a plurality of light emitting diodes (LEDs). The connections 20 are arranged to spell the word "EXIT" 16 and to form the arrows 18. For purposes of illustration, an LED 22 is shown in dotted outline connected at connecting points 24 and 26. The display board 14 includes first and second power connections 28 and 30 to which voltage is applied to illuminate the LEDs 22 of the exit sign 10. By examination of FIG. 2, it can be seen that the LED connections 20 are linked in series combinations of three throughout the display board 14 and that each series combination is connected in parallel across the power connections 28 and 30.

Figure 3:
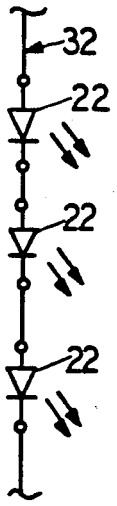
FIG. 3 is an electrical diagram showing three series connected light emitting diodes.

FIG. 3 shows a series combination 32 of three light emitting diodes 22 for use in the display board 14 of FIG. 2. A forward voltage drop of 2.1 volts is required across each of the LEDs 22 for proper operation. Thus, the voltage drop required across the combination 32 of FIG. 3 is 6.3 volts. Since the display board 14 of FIG. 2 includes only the series combinations 32 of three LEDs 22, 6.3 volts must be applied across the power connection points 28 and 30 for proper operation.

Figure 4:
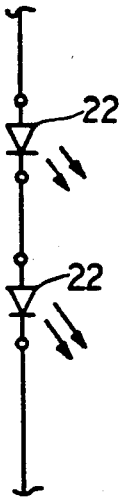
FIG. 4 is an electrical diagram showing two series connected light emitting diodes.

FIG. 4 shows two light emitting diodes 22 connected in a series combination 34 which may be used in place of the three light emitting diodes 22 of FIG. 3. The voltage required for application across the combination 34 of FIG. 4 is 4.2 volts, therefore, should the display board 14 of FIG. 2 be arranged in such a way as to include only LEDs 22 in series combinations 34 of two, a 4.2 volt power supply would be required at power connecting points 28 and 30.

Figure 5:
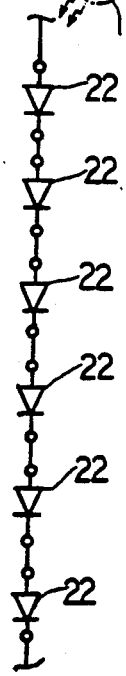
FIG. 5 is an electrical diagram showing six series connected light emitting diodes.

Similarly, FIG. 5 shows six series connected light emitting diodes 22. For proper operation, a 12.6 volt power supply must be applied across a combination 36 of FIG. 5. Therefore, if the display board 14 of FIG. 2 were arranged to include only light emitting diodes 22 in series combinations 36 of six, a 12.6 volt power supply must be applied to the leads 28 and 30. It may be seen from the foregoing that any number of series connected LEDs may be used in the present device.

Figure 6:
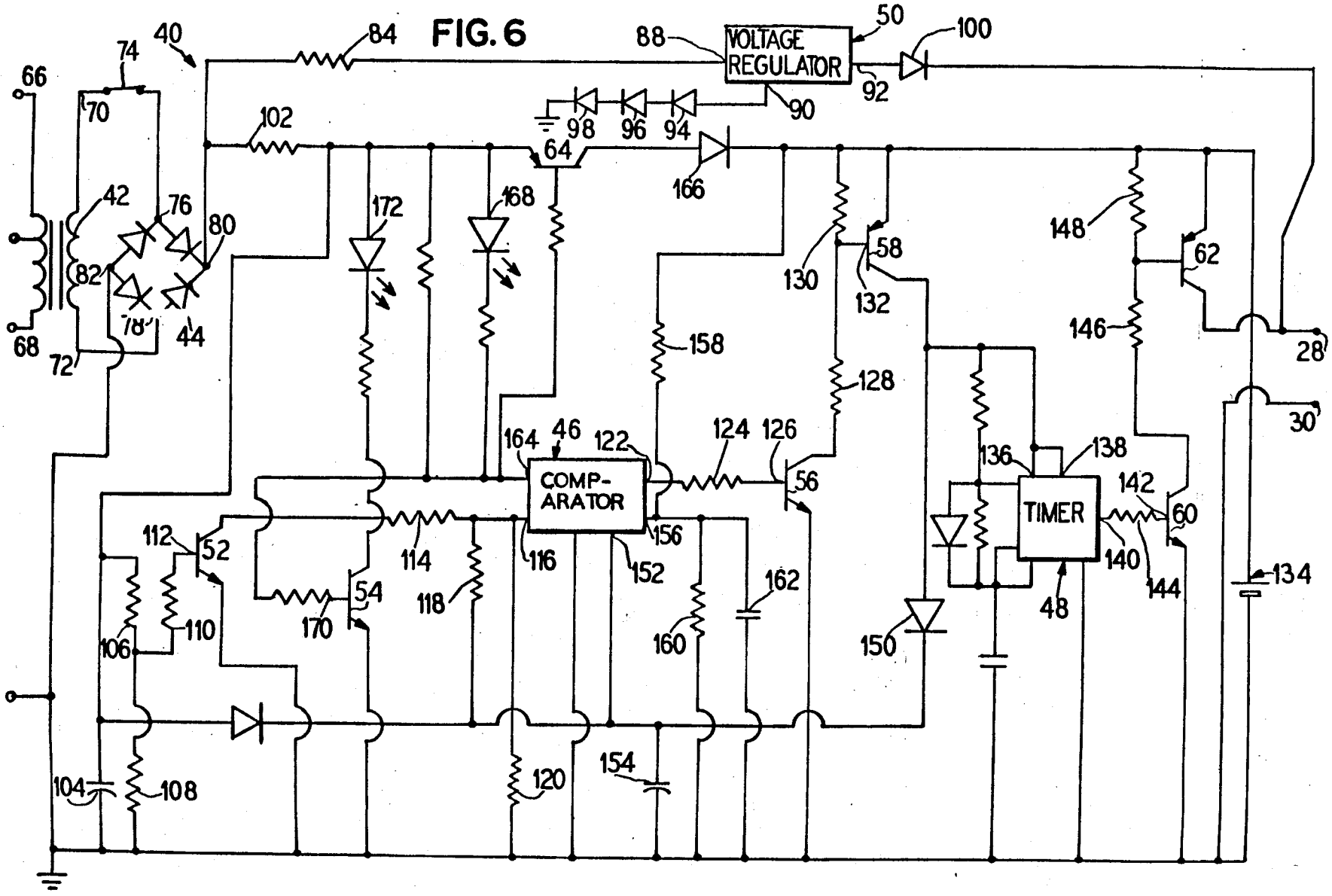
FIG. 6 is a circuit diagram of a control circuit for use in the emergency exit sign of FIG. 1.

FIG. 6 shows a control circuit 40 for applying power to the display board 14 of FIG. 2. The control circuit 40 includes a transformer 42, a bridge rectifier 44, a comparator 46, a multi-vibrator 48, a voltage regulator 50, and transistors 52, 54, 56, 58, 60, 62, and 64, as well as a variety of other circuit elements to insure proper operation. A power line, such as a 110 volt AC power line, is connected across leads 66 and 68 of the transformer 42 producing, in a preferred embodiment, a 10 volt AC signal at outputs 70 and 72 of the transformer 42. The 10 volt AC signal is applied through test switch 74, the importance of which will be discussed hereinafter, to inputs 76 and 78 of the bridge rectifier 44. A full wave rectified signal appears at rectifier outputs 80 and 82 which is applied through resistor 84 to the voltage regulator 50 at an input 88. The voltage regulator 50 of a preferred embodiment is a 5 volt regulator and has a ground connection 90 and an output 92. The ground connection 90 is connected to circuit ground through three series connected diodes 94, 96 and 98. This results in the output voltage of the regulator 50 being raised by 6.3 volts, or the sum of the 2.1 volt drop across each of the diodes 94, 96 and 98. The regulator output is then fed through diode 100 to the power connections 28 and 30, which are the same power connections as on the display board 14 shown in FIG. 2.

The full wave rectified signal is fed through resistor 102 and filtered by capacitor 104 to produce an essentially DC signal. The DC signal is divided by voltage divider resistors 106 and 108 and applied through resistor 110 to base 112 of the transistor 52. The application of power to the base 112 of transistor 52 causes the transistor 52 to begin conducting, which acts through resistor 114 to pull pin 116 of the comparator 46 below a threshold level. The resistors 118 and 120 had been maintaining the pin 116 above the threshold level, which in a preferred embodiment is 5.85 volts. Pulling the voltage at pin 116 below the threshold level results in a low state being produced at pin 122 of the comparator 46. The low is applied through resistor 124 to base 126 of the transistor 56 to cause the transistor 56 to assume a non-conducting state.

If AC power is interrupted, the transistor 52 will cease conducting and allow the voltage at the pin 116 of the comparator 46 to rise above the threshold level which will result in a high signal at the pin 122 of the comparator 46. The high signal at the pin 122 is applied through the resistor 124 to the base 126 of the transistor 56, causing the transistor 56 to commence conducting and draw current through resistors 128 and 130. The flow of current through the voltage divider resistors 128 and 130 causes a voltge to be applied to base 132 of the transistor 58 so that transistor 58 is turned on which causes voltage from battery 134 to be applied to pins 136 and 138 of the multivibrator, or timer, 48. The application of power to the pins 136 and 138 causes output 140 of the timer 48 to oscillate. The oscillating signal is applied to base 142 of the transistor 60 through resistor 144. Consequently, the transistor 60 switches on and off at the timer oscillation rate. The switching of transistor 60 operates through resistors 146 and 148 to cause the transistor 62 likewise to switch on and off at the timer oscillation rate. Each time the transistor 62 is switched on, it applies voltage from the battery 134 to the power leads 28 and 30 of the display board 14, and each time the transistor is switched off, the battery voltage is disconnected from the power leads 28 and 30. Therefore, interruption of AC line power to the circuit results in the LEDs 22 in the exit sign 10 flashing at the oscillation rate of the timer 48.

As the transistor 58 begins conducting, battery voltage is also applied through diode 150 to pin 152 of the comparator 46. Capacitor 154 is of sufficiently high capacitance value to enable the pin 152 to remain high.

Should AC power remain off for a long period of time and the battery voltage drop below the threshold set at the pin 116 of the comparator 46, the pin 122 will assume a low state, cutting off the transistor 56 in turn cutting off the transistor 58. This has the effect of disconnecting the battery 134 from the power connections 28 and 30.

Should AC line power resume, the transistor 52 again is turned on which results in power being supplied to the load as described above. Pin 156 of the comparator 46 senses the battery voltage during AC power through resistors 158 and 160 and capacitor 162. Hysteresis is built into the comparator 46 by the provision of feedback to the pin 156 so that upper and lower threshold levels are established for sensing battery voltage. When the pin 156 reaches the lower threshold limit, indicating that the battery 134 voltage is low, a low state is produced on pin 164 of the comparator 46, and when the pin 156 reaches the higher threshold limit, indicating that the battery 134 is fully charged, a high signal is produced on the pin 164. A low state at the pin 164 turns on the transistor 64 which applies charging current to the battery 134 through diode 166. A low state on the pin 164 also draws current through diode 168, which is a light emitting diode, indicating that the battery is charging.

As the battery 134 charges it will eventually become fully charged causing the pin 156 to reach the upper threshold limit which produces a high state at pin 164. The high state at the pin 164 turns off the transistor 64 and the light emitting diode 168 and applies a high signal to base 170 of the transistor 54, causing it to conduct. When the transistor 54 is turned on, it draws current through light emitting diode 172 which indicates that the battery 134 is fully charged. The diodes 168 and 172 are preferably of different colors for ease of identification.

Operation of the normally closed test switch 74 to an open position disconnects the bridge rectifier 44 from AC power enabling the control circuit 40 to switch to battery power. The test swtich, thus, tests the circuit operation and the condition of the battery 134.

Thus, there has been shown and described an illuminated exit sign and a control circuit that uses lowe power and long life light emitting diodes and that functions on AC or DC power. Furthermore, during a power shortage, when an illuminated exit sign is needed most, the light sources within the present sign flash drawing attention to itself. The present invention also provides means for automatically charging a battery so that the lights are illuminated at their brightest for the longest possible time during a power outage.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

I claim:

1. An emergency sign comprising:
a housing,
at least one display board mounted within said housing,
a plurality of light emitting diodes arranged on said display board to form a perceiveable intelligence, said light emitting diodes connected in a plurality of series circuits, each of said series circuits having an identical number of light emitting diodes, said series circuits connected in parallel,
a control circuit connected across said series circuits for supplying power to said light emitting diodes, said control circuit including:
a transformer connected to AC power,
a rectifier connected to outputs of said transformer,
a voltage regulator connected across said rectifier and having an output connected to said plurality of series circuits,
a battery,
a comparator having a first input at a first threshold level connected to an output of said rectifier to trigger said first threshold level in response to signals from said rectifier, a first output of said comparator for transmitting a first triggering signal upon the triggering of said first threshold level,
means responsive to said first triggering signal for connecting said battery to said plurality of series circuits,
a second input of said comparator connected to said battery and having at least a second threshold level, a second output of said comparator for transmitting a second triggering signal upon the triggering of said second threshold level, and
means responsive to said second triggering signal for applying charging current to said battery.

2. An illuminated display means constructed and arranged to form a perceivable emergency intelligence, a control circuit for supplying power to said illuminated display means, including:
first and second AC inputs,
first and second load outputs,
a transformer connected to said first and second AC inputs,
a rectifier connected to outputs of said transformer to rectify an AC signal,
a voltage regulator connected to outputs of said rectifier, outputs of said voltage regulator linked to said first and second load outputs,
a comparator having a first input sensitive to a first threshold level and a first output responsive to triggering of said first threshold level, a second input of said comparator being sensitive to a second threshold level and a second output responsive to triggering of said second threshold level,
means connected to said outputs of said rectifier for triggering said first threshold level at said first comparator input when a rectified AC signal is present at said rectifier,
a multivibrator responsive to said first comparator output,
a battery,
means connected to an output of said multivibrator for alternatively connecting and disconnecting said battery to said first and second load outputs when an AC signal is not present,
said second comparator input connected for sensing the voltage of said battery,
means for charging said battery when the battery voltage is below said second threshold level and an AC signal is present, said charing means being connected to said second comparator output,
said first comparator input connected for sensing the voltage of said battery,
means for disconnecting said battery from said first and second load outputs when the battery voltage is below said first threshold level, said disconnecting means being connected to said first comparator output.

3. An illuminated display means as claimed in claim 2 further comprising a test switch for disconnecting said rectifier from said transformer.

4. An illuminated display means as claimed in claim 2 wherein said rectifier is a full wave bridge rectifier.

5. An illuminated display means as claimed in claim 2 further comprising a plurality of diodes in series linking a ground lead of said voltage regulator to circuit ground of said control circuit.

6. An illuminated display means as claimed in claim 2 further comprising indicator means for indicating when said battery is being charged.

7. An illuminated emergency sign, comprising:
a plurality of series combinations of light emitting diodes disposed in an array to form a perceivable intelligence,
a control circuit connected to provide power to said plurality of series combinations, said control circuit including:
first and second AC inputs,
first and second load outputs for connection across the plurality of series combinations,
a transformer having a first winding connected to said first and second AC inputs and a second winding inductively coupled thereto;
a bridge rectifier connected across said second transformer winding,
a normally closed test switch connected between said second winding and said bridge rectifier,
a voltage regulator connected to outputs of said bridge rectifier and having regulated outputs connected to said first and second load outputs, said voltage regulator having a ground connection,
a predetermined number of diodes in series linking said regulator ground connection to ground,
a filter connected across said outputs of said bridge rectifier to filter rectified AC signals,
a voltage divider connected in parallel with said filter,
a first active element connected to said voltage divider responsive to filtered signals,
a comparator having a first input at a first threshold level connected to said first active element whereby response of said first active element to said filtered signals triggers said first threshold level,
a first output of said comparator for transmitting a trigger signal in response to triggering of said first threshold level,
a battery,
a second active element connected to said comparator output and responsive to receipt of said trigger signal to transmit voltage from said battery,
a multivibrator circuit connected to receive said battery voltage when said second active element responds to said trigger signal, a third active element connected to an output of said multivibrator circuit and to said battery and said first and second load outputs to apply voltage from said battery to said load outputs on receipt of a signal from said multivibrator circuit, a second input of said comparator connected to said battery and having second and third threshold levels, a second ouptut of said comparator generating first and second charge signals in response to triggering of said second and third threshold levels, a fourth active element connected to said second comparator output and connected between said rectifier and said battery to apply charging current to said battery on receipt of said first charge signal, a first indicator connected to said fourth active element to indicate the operation thereof, a fifth active element connected to said second comparator output responsive to said second charging signal, and a second indicator connected to said fifth active element to indicate the operation thereof.

8. An emergency sign, comprising:

a housing at least one display board mounted within said housing, a plurality of light emitting diodes arranged on said display board, said light emitting diodes connected in a plurality of series circuits, each of said series circuits having an identical number of light emitting diodes, said series circuits connected in parallel, a power control circuit means connected across said series circuits for supplying power to said light emitting diodes, a battery, a comparator having a first input at a first threshold level connected to said power control circuit means to trigger said first threshold level in response to signals from said power control circuit means, a first output of said comparator for transmitting a first triggering signal upon the triggering of said first threshold level, means responsive to said first triggering signal for connecting said battery to said plurality of series circuits, a second input of said comparator connected to said battery and having at least a second threshold level, a second output of said comparator for transmitting a second triggering signal upon the triggering of said second threshold level, and means responsive to said second triggering signal for applying charging current to said battery.

9. An emergency sign as claimed in claim 8, wherein said power control circuit means includes a rectified AC source.

* * * * *